United States Patent [19]

Littmann

[11] Patent Number: 4,478,653

[45] Date of Patent: Oct. 23, 1984

[54] PROCESS FOR PRODUCING GRAIN-ORIENTED SILICON STEEL

[75] Inventor: Martin F. Littmann, Middletown, Ohio

[73] Assignee: Armco Inc., Middletown, Ohio

[21] Appl. No.: 473,775

[22] Filed: Mar. 10, 1983

[51] Int. Cl.[3] ..... H01F 1/04

[52] U.S. Cl. ..... 148/111; 148/112

[58] Field of Search ..... 148/110, 111, 112, 113

[56] References Cited

U.S. PATENT DOCUMENTS

| | | | |
|---|---|---|---|
| 2,535,420 | 12/1950 | Jackson | 148/112 |
| 2,599,340 | 6/1952 | Littmann et al. | 148/113 |
| 2,867,558 | 1/1959 | May | 148/111 |
| 2,867,559 | 1/1959 | May | 148/111 |
| 3,278,346 | 10/1966 | Goss | 148/112 |
| 3,695,946 | 10/1972 | Demeaux | 148/111 |
| 3,764,406 | 10/1973 | Littmann | 148/110 |
| 3,770,517 | 11/1973 | Gray et al. | 148/112 |
| 3,843,422 | 10/1974 | Henke | 148/112 |
| 3,855,020 | 12/1974 | Salsgiver et al. | 148/112 |
| 3,872,704 | 3/1975 | Ohya et al. | 148/111 |
| 3,933,537 | 1/1976 | Imanaka et al. | 148/112 |
| 4,006,044 | 2/1977 | Oya et al. | 148/110 |
| 4,202,711 | 5/1980 | Littmann et al. | 148/113 |
| 4,206,004 | 6/1980 | Ohashi et al. | 148/113 |
| 4,212,689 | 7/1980 | Shimizu et al. | 148/111 |

*Primary Examiner*—John P. Sheehan

*Attorney, Agent, or Firm*—Frost & Jacobs

[57] ABSTRACT

A process for producing silicon steel strip of less than 0.30 mm thickness having cube-on-edge orientation, which comprises heating a silicon steel slab to 1300°-1400° C., hot rolling to hot band thickness, removing hot mill scale, cold rolling to intermediate thickness without annealing the hot rolled band, subjecting the intermediate thickness cold rolled material to an intermediate anneal at a temperature of 1010° to about 1100° C. with a total time of heating and soaking of less than about 180 seconds, cold rolling to a final thickness of less than 0.30 mm, decarburizing, applying an annealing separator, and finally annealing in conventional manner.

11 Claims, No Drawings

PROCESS FOR PRODUCING GRAIN-ORIENTED SILICON STEEL

BACKGROUND OF THE INVENTION

This invention relates to the production of regular grade cube-on-edge oriented silicon steel strip and sheet of less than 0.30 mm thickness by a simplified process. More particularly, the process of the invention omits an anneal of the hot rolled material with consequent saving in energy costs and processing time, without sacrificing the magnetic properties. This is made possible by conducting an anneal of the cold rolled strip at intermediate thickness at a higher temperature than that of a conventional intermediate anneal.

The so-called "regular grade" silicon steel having the cube-on-edge orientation utilizes manganese and sulfur (and/or selenium) as a grain growth inhibitor. In contrast to this, "high permeability" silicon steel relies upon aluminum nitrides in addition to or in place of manganese sulfides and/or selenides as a grain growth inhibitor.

The process of the present invention is applicable only to regular grade grain oriented silicon steel, and hence purposeful aluminum and nitrogen additions are not utilized.

The conventional processing of regular grade grain oriented silicon steel strip and sheet comprises the steps of preparing a melt of silicon steel in conventional facilities, refining and casting in the form of ingots or strand cast slabs. The cast steel preferably contains, in weight percent, from about 0.02% to 0.045% carbon, about 0.04% to 0.08% manganese, about 0.015% to 0.025% sulfur and/or selenium, about 3% to 3.5% silicon, not more than about 50 ppm nitrogen, not more than about 30 ppm total aluminum, and balance essentially iron.

If cast into ingots, the steel is conventionally hot rolled into slabs. The slabs (whether obtained from ingots or continuously cast) are heated (or reheated) to a temperature of about 1300° to 1400° C. in order to dissolve the grain growth inhibitor prior to hot rolling, as disclosed in United States Pat. No. 2,599,340. The slabs are then hot rolled, annealed, cold rolled in two stages with an intermediate anneal, decarburized, coated with an annealing separator and subjected to a final anneal in order to effect secondary recrystallization.

Representative processes for producing regular grade cube-on-edge oriented silicon steel strip and sheet are disclosed in United States Pat. Nos. 4,202,711; 3,764,406; and 3,843,422.

The process of U.S. Pat. No. 4,202,711 includes hot rolling of a strand cast slab with a finish temperature greater than 900° C., an anneal of the hot band at 925° to 1050° C., pickling, cold rolling in two stages with an intermediate anneal within the temperature range of 850° to 950° C. and preferably at about 925° C. with a soak time of about 30 to 60 seconds. The material is then cold rolled to final thickness, decarburized, coated with an annealing separator and finally annealed in a hydrogen-containing atmosphere.

United States Pat. No. 2,867,558 discloses a process for producing cube-on-edge oriented silicon-iron wherein a hot reduced silicon-iron band containing more than 0.012% sulfur is cold reduced at least 40%, subjected to an intermediate anneal between 700° and 1000° C. to control the average grain size between about 0.010 and about 0.030 mm, further cold reduced at least 40% to final thickness, and finally annealed at a temperature of at least 900° C. It was alleged that excessive grain growth occurred at intermediate annealing temperatures above 945° C. unless relatively large amounts of sulfur and manganese (or titanium) were present in the silicon-iron. Thus, a sulfur content of 0.046% and a manganese content of 0.110% were required in order to avoid a grain size in excess of 0.030 mm when annealing at 975° C. for 15 minutes.

United States Pat. No. 2,867,559 discloses the effect of intermediate annealing time and temperature on grain size and percent of cube-on-edge orientation for a single composition selected from U.S. Pat. No. 2,867,558, containing 3.22% silicon, 0.052% manganese, 0.015% sulfur, 0.024% carbon, 0.076% copper, 0.054% nickel, and balance iron and incidental impurities. The intermediate annealing temperature disclosed in this patent ranged from 700° to 1000° C. and the total annealing times of 5 minutes or more.

United States Pat. No. 4,212,689 discloses that nitrogen should be decreased to a low level of not more than 0.0045% and preferably not more than 0.0025% in order to achieve a very high degree of grain orientation. The process involves an initial anneal of hot rolled silicon steel at 950° C., cold rolling to intermediate thickness, conducting an intermediate anneal at 900° C. for 10 minutes, and further processing in conventional manner except for an additional final annealing treatment.

Other patents of which applicant is aware include U.S. Pat. Nos. 3,872,704; 3,908,737 and 4,006,044.

SUMMARY OF THE INVENTION

Omission of the initial anneal of hot rolled band has been attempted previously in order to minimize energy costs, and it was found that this anneal could be omitted without sacrifice of magnetic properties when producing grain oriented strip and sheet having a final thickness greater than about 0.30 mm. However, worse magnetic properties were obtained by omission of the initial anneal for grain oriented strip and sheet of less than 0.30 mm thickness when following conventional practice. More particularly, both core loss and permeability were found to be affected adversely. The present invention involves the discovery that excellent magnetic quality can be obtained in strip and sheet material having a final thickness less than 0.30 mm when the initial anneal is omitted, primarily by increasing the temperature of the intermediate anneal after the first stage of cold rolling to a range of 1010° to about 1100° C.

According to the invention there is provided a process for producing cold reduced silicon steel strip and sheet of less than 0.30 mm thickness having the cube-on-edge orientation, comprising the steps of providing a slab of silicon steel containing about 3% to about 3.5% silicon, heating the slab to a temperature of about 1300° to 1400° C., hot rolling to hot band thickness with a finish temperature less than 1010° C., removing hot mill scale, cold rolling to an intermediate thickness without annealing the hot band, subjecting the cold rolled intermediate thickness material to an intermediate anneal at a temperature of 1010° to about 1100° C. with a total time of heating and soaking of less than about 180 seconds, cold rolling to a final thickness of less than 0.30 mm, decarburizing, coating the decarburized strip with an annealing separator, and subjecting the coated strip to a final anneal under reducing conditions at a temperature of about 1150° to 1250° C. to effect secondary recrystallization.

Preferably the composition of the slab consists essentially of, in weight percent, from about 0.020% to 0.040% carbon, about 0.040% to 0.080% manganese, about 0.015% to 0.025% sulfur and/or selenium, about 3.0% to 3.5% silicon, less than about 30 ppm total aluminum, and balance essentially iron.

DETAILED DESCRIPTION

In the present process melting and casting are conventional, and the steel is hot rolled to a preferred thickness of about 2 mm, with a preferred finish temperature of about 950° C. This is followed by removal of the hot mill scale, but the hot band is not annealed prior to the first stage of cold rolling.

The intermediate anneal after the first stage of cold rolling is conducted between 1010° and 1100° C. and preferably at about 1050° C. The total time of heating plus soaking is preferably less than 120 seconds. The soak at temperature is preferably less than 60 seconds and more preferably about 20 to 40 seconds. Preferably a non-oxidizing atmosphere, such as nitrogen or a nitrogen-hydrogen mixture, is used.

The relatively short duration of less than about 90 seconds soak time and 180 seconds total time for the high temperature intermediate anneal is in sharp contrast to the prior art procedures wherein a minimum of 5 minutes was used with an annealing temperature of 1000° C. (U.S. Pat. No. 2,867,559).

The minimum strip temperature of 1010° C. in the present invention contrasts with a maximum temperature of 950° C. used for a soak time of 30 to 60 seconds (U.S. Pat. No. 4,202,711).

It has been found that best results are obtained when the intermediate anneal is conducted with a relatively high heating rate, i.e. a heating time of less than 60 seconds to bring the intermediate thickness strip to annealing temperature.

Usual thicknesses for strip processed to final thicknesses less than 0.30 mm range from about 0.20 to about 0.28 mm. The intermediate thickness for such strip is about 1.8 to 2.8 times the final thickness and preferably about 2.3 times the final thickness.

Preliminary tests indicated that for final thicknesses of greater than 0.30 mm conventional processing, except for omission of the anneal of the hot band, affected magnetic quality only slightly, whereas the same processing applied to strip having a final thickness less than 0.30 mm adversely affected both core loss and permeability. The following data, wherein core loss was measured in watts per pound at 1.7 Tesla and permeability at 800 ampere turns per mm, are representative of these preliminary tests:

| | | Initial Anneal 982° C. | | Without Initial Anneal | |
|---|---|---|---|---|---|
| | | Interm. Anneal 917° C. | | Interm. Anneal 917° C. | |
| Thickness (mm) | | P17; 60 | Perm | P17; 60 | Perm |
| Interm. | Final | w/lb | H = 10 | w/lb | H = 10 |
| 0.74 | 0.345 | 0.790 | 1830 | 0.794 | 1828 |
| 0.61 | 0.264 | 0.675 | 1834 | 0.761 | 1780 |

It will be apparent from the above tabulation that only a small change in core loss and permeability resulted from omission of the initial anneal at a final thickness of 0.345 mm, whereas at a final thickness of 0.264 mm, both core loss and permeability were substantially inferior, as compared to the values for that thickness using an initial anneal.

Subsequent tests in accordance with the process of the present invention demonstrated that an increase in the intermediate anneal temperature within the range of 1010° to about 1100° C. compensated for omission of an initial anneal of the hot band.

Center hot band samples were selected from two heats and tested in order to ascertain the effects of hot finish temperature and intermediate anneal temperature, without an initial anneal of the hot band material. The compositions of the hot band samples are set forth in Table I. Two different finishing temperatures were used for each of the compositions, and these are also set forth in Table I together with serial numbers assigned thereto for identification. Magnetic properties resulting from the variations in hot finishing temperature and intermediate anneal temperature are set forth in Table II.

Preliminary preparation of the hot band samples of Table I involved prerolling of strand cast slabs from a thickness of 203 mm to a thickness of 152 mm, reheating to 1400° C., hot rolling to a thickness of 1.93 mm, and scale removal. After cold reduction to the final thicknesses reported in Table II, decarburization was carried out at 830° C. in a mixture of wet $H_2$ and $N_2$. The samples were then coated with magnesium oxide. After a conventional final box anneal at 1200° C. the sheets were sheared into Epstein samples and stress relief annealed prior to magnetic testing.

The data in Table II indicate the need for an intermediate anneal of at least 1010° C. when no initial anneal is used. A lower hot finishing temperature also appears beneficial.

The data in Table II further show that the thinner gages (0.224 mm) are more difficult to process but produce good results. The higher intermediate anneal is even more important and lower hot finishing temperatures are beneficial.

The best intermediate anneal temperature appears to be within the range of 1040° to 1065° C. for both the heats tested.

Intermediate anneal thermal cycles of samples reported in Table II were checked with thermocouples attached to strip samples, and soak times ranged from 25 seconds to 37 seconds. The specific relation between thickness, soak temperature and soak time for these samples are set forth in Table III.

Table IV shows the influence of extending the time of soak during the intermediate anneal at 955° C. In comparing the results with Table II it will be seen that the magnetic quality is not as good as the higher temperature soak for shorter times. The ability to use total annealing times of less than about 120 seconds increases productivity and hence is economically beneficial and cost effective.

Additional tests have been conducted on coils from five different commercial heats, utilizing samples from the front (F) and back (B) ends of the coils (order reversed from hot rolling). These tests compared magnetic properties directly under four different heat treatment conditions at two different final thicknesses and with different intermediate thicknesses.

Results of these additional tests are summarized in Table V.

Identification of heat treatment conditions reported in Table V is as follows:

A = Initial anneal at 1010° C. and intermediate anneal at 950° C.

B = Initial anneal at 1010° C. and intermediate anneal at 1060° C.

C = No initial anneal and intermediate anneal at 950° C.

D = No initial anneal and intermediate anneal at 1060° C.

Core loss and permeability values were measured in a manner similar to the tests reported hereinabove, i.e., watts per pound at 1.5 and 1.7 Tesla, and 800 ampere turns per mm.

The compositions of the steels utilized in the tests reported in Table V, analyzed at the hot band stage, ranged between 0.026% and 0.028% carbon, 0.058% and 0.064% manganese, 0.016% and 0.023% sulfur, 3.05% and 3.17% silicon, 36 and 49 ppm nitrogen, less than 30 ppm aluminum, less than 30 ppm titanium, and balance essentially iron. Hot roll finish temperatures ranged from about 980° to 990° C., and the processing was the same as that described above for steels of Table I.

It will be evident from the data of Table V that the average magnetic properties of those samples which were not subjected to an initial anneal (conditions C and D) were slightly inferior to those of the samples which were subjected to an initial anneal (conditions A and B), at a final thickness of 0.264 mm. However, the average permeability for Condition D samples compared very favorably with Condition A, and several samples exceeded a permeability of 1850.

At a final thickness of 0.224 mm the magnetic properties of samples not subjected to an initial anneal were inferior to those which were subjected to an initial anneal, but the marked superiority of condition D samples (in accordance with the invention) over those of condition C demonstrates the criticality of a minimum temperature of 1010° C. for the intermediate annealing step of the invention.

It is therefore apparent that the process of the present invention achieves the objective of producing regular grade cube-on-edge oriented silicon steel strip and sheet of less than 0.30 mm thickness without initial anneal of the hot band, while maintaining magnetic properties within acceptable limits.

TABLE I

Compositions

| Heat | % C | % Mn | % S | % Si | ppm N | Hot Roll Finish Temp. °C. | Serial No. |
|---|---|---|---|---|---|---|---|
| 400826 | .029 | .064 | .018 | 3.06 | 36 | 1000 | 1277 |
| | | | | | | 955 | 1280 |
| 200693 | .027 | .057 | .019 | 3.05 | 54 | 1004 | 1247 |
| | | | | | | 957 | 1250 |

TABLE II

Magnetic Properties vs. Hot Finishing Temperature & Intermediate Anneal

| Heat No. | Serial No. | Hot Finish Temp. | Final Gage 0.264 mm Core. Loss (P17) | Final Gage 0.264 mm Perm | Final Gage 0.224 mm Core Loss (P17) | Final Gage 0.224 mm Perm |
|---|---|---|---|---|---|---|
| A - 955° C. Intermediate Anneal | | | | | | |
| 400826 | 1277 | 1000° C. | .876 | 1713 | 1.015 | 1594 |
| 200693 | 1247 | 1000° C. | .699 | 1814 | .768 | 1756 |
| | | Avg. | .787 | 1763 | .892 | 1675 |
| 400826 | 1280 | 955° C. | .689 | 1814 | .876 | 1680 |
| 200693 | 1250 | 955° C. | .720 | 1809 | .735 | 1774 |
| | | Avg. | .704 | 1812 | .806 | 1727 |
| B - 1010° C. Intermediate Anneal | | | | | | |
| 400826 | 1277 | 1000° C. | .669 | 1840 | .726 | 1776 |
| 200693 | 1247 | 1000° C. | .672 | 1846 | .665 | 1817 |
| | | Avg. | .670 | 1843 | .696 | 1796 |
| 400826 | 1280 | 955°C. | .647 | 1853 | .715 | 1778 |
| 200693 | 1250 | 955° C. | .622 | 1848 | .604 | 1820 |
| | | Avg. | .654 | 1850 | .660 | 1799 |
| C - 1065° C. Intermediate Anneal | | | | | | |
| 400826 | 1277 | 1000° C. | .672 | 1833 | .693 | 1794 |
| 200693 | 1247 | 1000° C. | .670 | 1846 | .660 | 1813 |
| | | Avg. | .671 | 1840 | .676 | 1804 |
| 400826 | 1280 | 955° C. | .638 | 1854 | .622 | 1811 |
| 200693 | 1250 | 955° C. | .659 | 1850 | .664 | 1804 |
| | | Avg. | .648 | 1852 | .663 | 1810 |

TABLE III

Heating Time

| Intermediate Thickness mm | Soak Temp. °C. | Total Time sec. | Soak Time sec. |
|---|---|---|---|
| 0.61 | 955 | 98 | 37 |
| 0.48 | | 84 | 33 |
| 0.61 | 1010 | 98 | 27 |
| 0.48 | | 84 | 25 |
| 0.61 | 1065 | 98 | 29 |
| 0.48 | | 84 | 30 |

TABLE IV

Intermediate Anneal Soak (955° C.) vs. Magnetic Properties

| Serial No. | Core Loss | Perm | Soak Time-sec. | Total Time-sec. |
|---|---|---|---|---|
| (Intermediate Gage 0.61 mm–0.264 mm Final Gage) | | | | |
| 1277 | .876 | 1713 | 37 | 98 |
| | .805 | 1766 | 87 | 147 |
| 1280 | .689 | 1814 | 37 | 98 |
| | .690 | 1844 | 87 | 147 |
| 1247 | .699 | 1823 | 37 | 98 |
| | .683 | 1832 | 87 | 147 |
| 1250 | .720 | 1809 | 37 | 98 |
| | .676 | 1834 | 87 | 147 |
| (Intermediate Gage 0.48 mm–0.224 mm Final Gage) | | | | |
| 1277 | 1.015 | 1594 | 33 | 84 |
| | .974 | 1624 | 87 | 127 |
| 1280 | .876 | 1680 | 33 | 33 |
| | .824 | 1712 | 84 | 84 |
| 1247 | .768 | 1756 | 33 | 33 |
| | .749 | 1764 | 84 | 84 |
| 1250 | .735 | 1774 | 33 | 33 |
| | .703 | 1789 | 84 | 84 |

TABLE V

| | Magnetic Properties - Initial Anneal vs. No Initial Anneal | | | | | | | | | | | |
|---|---|---|---|---|---|---|---|---|---|---|---|---|
| | A | | | B | | | C | | | D | | |
| | Core Loss | | | Core Loss | | | Core Loss | | | Core Loss | | |
| Coil No. | P15 | P17 | Perm. | P15 | P17 | Perm. | P15 | P17 | Perm. | P15 | P17 | Perm. |
| | Final Gage 0.224 mm, Intermed. Gage 0.51 mm | | | | | | | | | | | |
| 1F | .400 | .594 | 1860 | .403 | .612 | 1847 | .633 | .986 | 1633 | .419 | .641 | 1840 |
| 1B | .412 | .627 | 1860 | .421 | .633 | 1848 | .573 | .919 | 1674 | .425 | .650 | 1835 |
| 88F | .421 | .657 | 1836 | .423 | .656 | 1813 | .572 | .918 | 1675 | .486 | .794 | 1741 |
| 88B | .399 | .604 | 1846 | .397 | .593 | 1857 | .459 | .734 | 1770 | .425 | .646 | 1833 |
| 103F | .399 | .595 | 1836 | .403 | .617 | 1839 | .557 | 902 | 1683 | .424 | .656 | 1831 |
| 103B | .401 | .613 | 1843 | .499 | .727 | 1776 | .664 | 1.02 | 1615 | .471 | .762 | 1767 |
| Avg. | .405 | .615 | 1842 | .416 | .640 | 1828 | .576 | .913 | 1675 | .442 | .692 | 1808 |
| | Final Gage 0.264 mm, Intermed. Gage 0.61 mm | | | | | | | | | | | |
| 1F | .464 | .686 | 1839 | .442 | .637 | 1863 | .497 | .773 | 1787 | .480 | .725 | 1818 |
| 1B | .456 | .665 | 1851 | .452 | .647 | 1861 | .480 | .723 | 1806 | .448 | .657 | 1857 |
| 88F | .445 | .651 | 1848 | .457 | .672 | 1835 | .556 | .882 | 1718 | .442 | .643 | 1858 |
| 88B | .440 | .631 | 1858 | .439 | .633 | 1862 | .508 | .784 | 1772 | .467 | .691 | 1827 |
| 103F | .449 | .649 | 1851 | .441 | .634 | 1859 | .453 | .670 | 1833 | .441 | .637 | 1852 |
| 103B | .449 | .654 | 1849 | .450 | .653 | 1852 | .521 | .827 | 1750 | .455 | .657 | 1858 |
| Avg. | .450 | .658 | 1849 | .447 | .646 | 1855 | .502 | .785 | 1794 | .456 | .679 | 1845 |

I claim:

1. A process for producing cold reduced silicon steel strip and sheet of less than 0.30 mm thickness having the cube-on-edge orientation, consisting the steps of providing a slab of silicon steel containing about 3% to about 3.5% silicon, heating the slab to a temperature of about 1300° to 1400° C., hot rolling to hot band thickness, removing hot mill scale, cold rolling to an intermediate thickness without annealing said hot band, subjecting the cold rolled intermediate thickness material to an intermediate anneal at a temperature of 1010° to about 1100° C. with a total time of heating and soaking of less than about 180 seconds, cold rolling to a final thickness of less than 0.30 mm, decarburizing, coating the decarburized strip with an annealing separator, and subjecting the coated strip to a final anneal under reducing conditions at a temperature of about 1150° to 1250° C. to effect secondary recrystallization.

2. The process claimed in claim 1, wherein said silicon steel slab consists essentially of, in weight percent, from about 0.020% to 0.040% carbon, about 0.040% to 0.080% manganese, about 0.015% to 0.025% sulfur and/or selenium, about 3.0% to 3.5% silicon, less than about 30 ppm total aluminum, and balance essentially iron.

3. The process claimed in claim 1, wherein said intermediate anneal is conducted in a non-oxidizing atmosphere.

4. The process claimed in claim 1, wherein said intermediate anneal is conducted with a soak time of less than about 90 seconds.

5. The process claimed in claim 1, wherein said intermediate anneal is conducted at a temperature between 1040° and 1065° C.

6. The process claimed in claim 1, wherein the hot roll finish temperature is less than 1010° C.

7. The process claimed in claim 1, wherein said slab is hot rolled to a thickness of about 2 mm.

8. The process claimed in claim 1, wherein the final thickness of said cold rolled strip is from about 0.20 to about 0.28 mm.

9. The process claimed in claim 8, wherein the thickness of the intermediate cold rolled material is from about 1.8 to about 2.8 times said final thickness.

10. The process claimed in claim 1, wherein said intermediate anneal is conducted with a total time of heating and soaking of less than about 120 seconds and a soak time of less than about 60 seconds.

11. The process claimed in claim 1, wherein the intermediate thickness material is heated to annealing temperature in said intermediate anneal in less than 60 seconds.

* * * * *